US006913354B2

(12) United States Patent
Rasmussen et al.

(10) Patent No.: US 6,913,354 B2
(45) Date of Patent: Jul. 5, 2005

(54) PRINT MEDIA HEATING TECHNIQUES FOR A VACUUM BELT HARD COPY APPARATUS

(75) Inventors: Steve O Rasmussen, Vancouver, WA (US); Geoff Wotton, Battleground, WA (US); Steven B Elgee, Portland, OR (US); Todd R Medin, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/342,505

(22) Filed: Jan. 14, 2003

(65) Prior Publication Data

US 2003/0137573 A1 Jul. 24, 2003

Related U.S. Application Data

(62) Division of application No. 09/588,941, filed on Jun. 6, 2000, now Pat. No. 6,536,894.

(51) Int. Cl.[7] ..... B41J 2/01
(52) U.S. Cl. ..... 347/102; 347/104
(58) Field of Search ..... 347/102, 104

(56) References Cited

U.S. PATENT DOCUMENTS 4,887,095 A * 12/1989 Wataya et al. ..... 347/218
5,896,154 A * 4/1999 Mitani et al. ..... 347/102

* cited by examiner

*Primary Examiner*—Stephen D. Meier
*Assistant Examiner*—Ly T Tran

(57) ABSTRACT

A print media preheating method and apparatus uses heat, vacuum, and mechanisms for drying and flattening a sheet prior to ink-jet printing thereon. Pre-shrinking the media, driving out and substantially reducing inherent moisture content prior to depositing wet ink thereon provides greater flatness in the print-zone whereby ink-jet print quality is improved.

9 Claims, 4 Drawing Sheets

PRINT MEDIA HEATING TECHNIQUES FOR A VACUUM BELT HARD COPY APPARATUS

CROSS REFERENCE TO RELATED APPLICATION(S)

This is a divisional of application Ser. No. 09/588,941 filed on Jun. 6, 2000, now U.S. Pat. No. 6,536,894 which is hereby incorporated by reference herein.

BACKGROUND OF THE INVENTION

1. Field of the Invention

The present invention relates generally to ink-jet printing and, more specifically, to vacuum belt-type ink-jet printers and the utilization of multiple belts and associated devices for heating and pressing print media.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5(October 1988), Vol. 43, No. 4 (August 1992), Vol. 43, No. 6 (December 1992) and Vol. 45, No.1 (February 1994) editions. Ink-jet devices are also described by W. J. Lloyd and H. T. Taub in *Output Hardcopy* [*sic* ] *Devices*, chapter 13 (Ed. R. C. Durbeck and S. Sherr, Academic Press, San Diego, 1988). [For convenience of describing ink-jet technology and the present invention, all types of print media are referred to simply as "paper," all compositions of colorants are referred to simply as "ink," and all types of hard copy apparatus are referred to simply as a "printer" No limitation on the scope of invention is intended nor should any be implied.]

FIG. 1 (PRIOR ART) depicts a generic, vacuum belt print media transport, ink-jet hard copy apparatus, in this exemplary embodiment a computer peripheral, ink-jet printer 10. An ink-jet writing instrument 12 (also referred to hereinafter as simply a "pen") is provided with a printhead 14 having drop generators (not seen in this view), including nozzles for ejecting ink droplets onto an adjacently positioned print medium, e.g., a sheet of paper 16, in the apparatus' printing-zone 34. An endless-loop belt 32 is one type of known manner printing-zone input-output paper transport. A motor 33 having a drive shaft 30 is used to drive a gear train 35 coupled to a belt pulley 38 mounted on a fixed axle 39; a known manner position tracking device 41 can be provided. A biased idler wheel 40 provides appropriate tensioning of the belt 32. The belt rides over a platen 36 in the print-zone 34. The platen 36 is associated with a known manner vacuum induction system 37. The paper sheet 16 is picked from an input supply (not shown) and its leading edge 54 is delivered to a guide 50, 52 where a pinch wheel 42 in contact with the belt 32 —or the belt vacuum force itself —grips the leading edge of the sheet to continue transport of the paper sheet 16 through the printing-zone 34 (the paper path is represented by arrow 31). Downstream of the printing-zone 34, an output roller 44 in contact with the belt 32 receives the leading edge 54 of the paper sheet 16 and continues the paper transport until the trailing edge 55 of the now printed page is released; in some implementations, suction force release is sufficient for allowing the sheet to leave the printing-zone 34 transport mechanisms. A system controller 62 provides the necessary signals for paper transport, writing instrument 12 operations, and the like as necessary for printer 10 operations. The carriage scanning axis is conventionally designated the x-axis, the print media transit axis is designated the y-axis, and the printhead firing direction is designated the z-axis.

One source of image quality degradation is print head crashes on the media surface. These crashes can be induced by the media rising up off the main printing belt into the swept volume of the printheads. The cause of the media buckling is usually due to the wet colorant ink-jet printing process itself. As the fluid from the ink droplets is absorbed by the paper fibers, regions of the media expand differently as a function of the volume of ink in the region. This is also referred to as "cockle," an irregular rather than planar surface produced in paper by the saturation and drying of ink deposits on the fibrous medium. As a sheet of paper gets saturated with ink, the paper grows and buckles in a seemingly random manner. Paper printed with images are more saturated with colorant than simple text pages and thus exhibit great paper cockle effects. Colors formed by mixing combinations of other color ink drops form greater localized saturation areas and also exhibit greater cockle tendencies.

One known solution for this problem is using a combination of heat, vacuum, and airflow to dry the media quickly, holding it down during the critical time just after ink deposition. However, this drying of the ink can also cause problems in local environmental conditions. Moreover, when media sits in a high humidity environment, it absorbs water from the air and stores the moisture in its fibrous structure, causing expansion. Therefore, even pre-printing, paper moisture content is a significant problem. Under common ambient atmospheric conditions (e.g., an office environment having a relative humidity of about 80% at 30° C.), paper commonly used for ink-jet printing can have a water content that is significant to the process. Depending on actual humidity, the moisture content of paper can be from about 1% to 10%. If an expanded sheet is then brought into a high temperature location, such as a heated print zone, the moisture in the fibers will be driven out and the media again will try to shrink. If this shrinkage is done abruptly to only a section of the media as opposed to the entire sheet at once, shrink cockle results. This can result in printhead crashes at raised regions.

Some types of print media heating techniques assigned to the common assignee of the present invention provide such exemplary prior art solutions:

- U.S. Pat. No. 5,287,123 for a PRE-HEAT ROLLER FOR THERMAL INK-JET PRINTER,
- U.S. Pat. No. 5,329,295 for a PRINT ZONE HEATER SCREEN FOR THERMAL INK-JET PRINTER,
- U.S. Pat. No. 5,399,039 for an INK-JET PRINTER WITH PRECISE PRINT ZONE MEDIA CONTROL,
- U.S. Pat. No. 5,406,321 for a PAPER PRECONDITIONING HEATER FOR INK-JET PRINTER,
- U.S. Pat. No. 5,428,384 for a HEATER BLOWER SYSTEM IN A COLOR INK-JET PRINTER,
- U.S. Pat. No. 5,461,408 for a DUAL FEED PAPER PATH FOR INK-JET PRINTER,
- U.S. Pat. No. 5,467,119 for an INK-JET PRINTER WITH PRINT HEATER HAVING VARIABLE HEAT ENERGY FOR DIFFERENT MEDIA,
- U.S. Pat. No. 5,510,822 for an INK-JET PRINTER WITH HEATED PRINT-ZONE, and
- U.S. Pat. No. 5,668,584 for a METHOD OF MULTIPLE ZONE HEATING OF INKJET MEDIA USING (A) SCREEN PLATEN.

In U.S. Pat. No. 5,742,315, Szlucha et al. describe a SEGMENTED FLEXIBLE HEATER FOR DRYING A PRINT IMAGE. A segmented flexible heater is disposed adjacently to a paper path for heating before and during printing. In U.S. Pat. No. 5,896,154 for an INK JET PRINTER, Mitani et al. describe a prior art belt type preheating unit.

In vacuum belt paper transport subsystems, sometimes heat is applied to the main belt with the vacuum being used to ensure contact to a heater. During heating, the paper 16 is dried. As moisture leaves the paper 16, the paper shrinks. This shrinkage is a change in paper size that is not matched by an equivalent change in the belt 32. Therefore, there will generally be relative motion between the two when the shrinkage occurs as the paper 16 is being transported by the belt 32 which can lead to dot placement error.

In vacuum belt systems, "edge-scalloping" of the sheet is a common occurrence. Edge-scalloping is generally a waviness occurring along the edges of a sheet due to a difference in the drying time from the central regions of the sheet, another form of cockling as described above. Edge-scalloping is a result of cockling effects compounded by irregular drying across the page area. The difference in heat exchange between the heater and the sheet is exacerbated in a vacuum transport system because vacuum loss around the sheet edges can lead to a loss of contact with a resultant loss of heat transfer. The interior regions of the sheet can dry faster and shrink faster than the edge regions. The resultant distortion is scalloped edges.

Actual shrinkage and other shape changes will of course be dependent on actual moisture content and paper thickness. Thus, preheating and print-zone heating of the paper can affect ultimate print quality characteristics. Temperature control is yet another factor which will be dependent on throughput time and media type.

There is a need for improved techniques of print media heating and flattening for a vacuum belt hard copy apparatus.

SUMMARY OF THE INVENTION

In its basic aspects, the present invention provides a method for flattening print media prior to ink-jet printing thereon, including the steps of: heating the print media over a predetermined time and temperature such that moisture content is substantially reduced prior to printing thereon; and pressing the print media upstream of printing thereon.

In another basic aspect, the present invention provides a print media preheating subsystem for an ink-jet hard copy apparatus, having a belt-type print media transport means for transporting print media via a vacuum belt along a media path through a print zone of the apparatus, the preheating subsystem including: upstream of the print zone, media transporting means for transporting print media along the path toward the print zone, the media transporting means including at least two complementary contact devices wherein the print media has each face thereof in contact with a respective device surface; and heating means for heating at least one of the contact devices surface such that heat is transferred to the print media therefrom.

In another basic aspect, the present invention provides a method for preheating an ink-jet print medium sheet prior to printing thereon in an ink-jet hard copy apparatus, including the steps of: pressing the sheet between a pair of print media transport devices in the print media transport path prior to printing on the media; moving the sheet with the devices toward a printing-zone of the apparatus; and heating a surface of at least one device of the pair of devices such that heat is transferred to the sheet substantially immediately prior to depositing ink thereon.

In another basic aspect, the present invention provides an ink-jet hard copy apparatus, including: an ink-jet writing instrument positioned adjacently to a printing-zone in a print media transport path of the apparatus; a vacuum belt subsystem for receiving a sheet of print media, including a vacuum belt for transporting the sheet through the printing-zone; and upstream of the printing-zone, a preheating subsystem having a media transport mechanism and a heater mechanism associated with the media transport mechanism wherein heat is applied by the preheating subsystem to at least one surface of the sheet prior to the sheet entering the printing-zone and receiving colorant from the writing instrument.

In another basic aspect, the present invention provides a print media ironing device for ink-jet printers having a vacuum transport belt for moving a sheet of print media through a print-zone, including: at least one heater providing a pre-shrinkage region wherein the sheet passing therethrough experiences a substantial moisture content reduction; and at least one ironing mechanism, downstream of said region, wherein the sheet is pressed into a substantially planar configuration prior to entering the print-zone.

Some advantages of the present invention are:

it provides improved heat transfer to print media;

it provides improved image quality;

it is scalable;

in one embodiment it can be used to eliminate the need for vacuum upstream of the print-zone;

it provides a flat, stable media for printing;

it adds a holddown force for media types that are permeable by the vacuum—induced air flow; and it prevents loss of vacuum at edges of all media types.

The foregoing invention summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 2A:
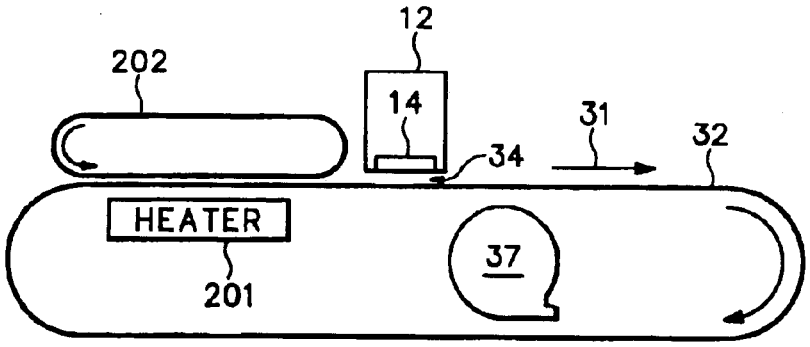
FIGS. 2A, 2B and 2C are schematic drawings of a first embodiment of the present invention.
Figure 2B:
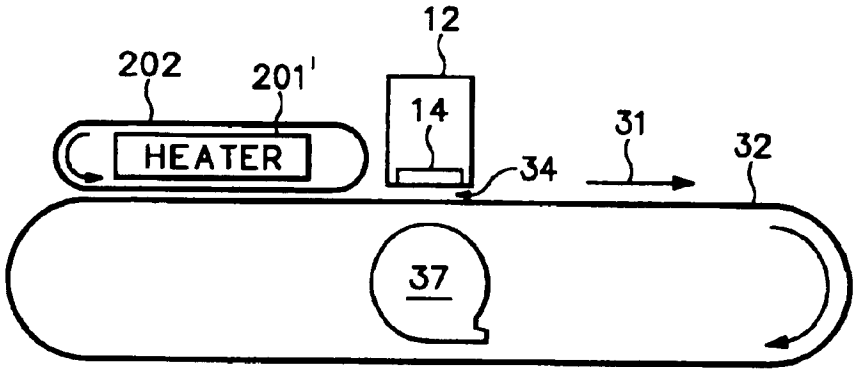
Figure 2C:
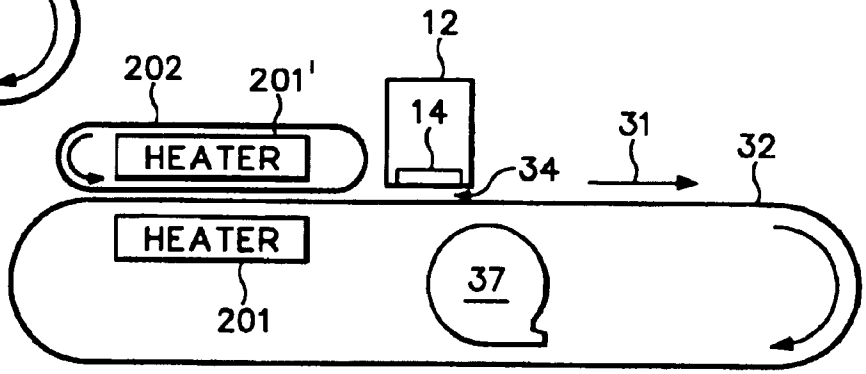

FIGS. 2A, 2B, and 2C are schematic illustrations of a two-belt embodiment of the print media preheating strategy of the present invention. In FIG. 2A, upstream of the print-zone 34 along the paper path 31, a heating device 201—such as a conductive heater (although other known devices may be used in any specific implementation as may be design expedient)—is positioned to heat a pre-printing positional region of the vacuum belt 32. An upper, endless-loop, transport belt 202 is positioned to provide a contact force, pressing the sheets of paper received from the input pick mechanism (not shown) between the two belts 32, 202. Both faces of the paper are in intimate contact with a belt surface. There are other known ways to force media against a heated platen, such as with a weight or pressurized belt. However, when vacuum is present, it is preferred to have only the belt 32 on the vacuum side perforated to ensure that no vacuum is lost on the opposite, top, side. The non-perforated belt is vacuumed against the perforated belt, helping to press the medium therebetween. Therefore, it is preferred to have heat and vacuum on the same side. It is also preferred that the non-perforated belt 202 be wider than the widest media selectable for a particular printer implementation. Vacuum tapers off at the media edge, so by using a wider, non-perforated belt 202, the vacuum on the media can be constant to the edges. Moreover, the vacuum subsystem 37 can be used to transport water vapor out of the printer 10.

FIG. 2B provides an implementation with a heater 201' operative in conjunction with the upper transport belt 202, heating the surface of the sheet which will receive ink in the print-zone 34, further reducing ink dry time and cockling of the sheet.

FIG. 2C provides and implementation with heater devices 201, 201' associated with both the vacuum belt 32 and the upper pressure belt 202. Note that this has an advantage for drying thicker media as heat is now applied to both sides.

The options of adding heat to one or both sides of the media can also optionally use vacuum or another known manner exhaust subsystem in the preheat zone (see description of FIG. 3C below). If only one heater is used, adding vacuum to the same side of the media that has the heating improves the heat transfer capability by reducing the thermal resistance. A temperature range of approximately 135° C.±15° has been employed, but a specific implementation may use a different range depending on the type of media used in the hard copy apparatus. Note that both belts may be driven, or the upper transport belt 202 may simply be idler mounted and driven by friction; a variety of implementations as would be known in the art can be employed.

Figure 1:
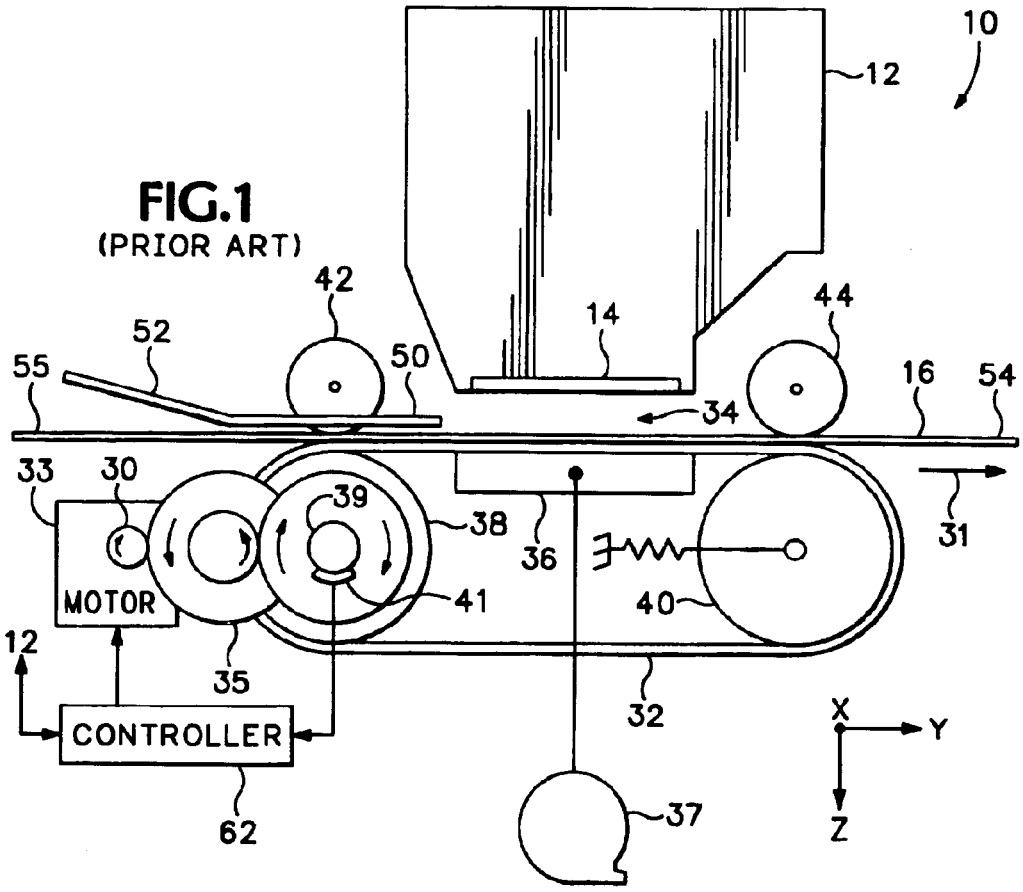
FIG.1 (PRIOR ART)
FIG. 1 (PRIOR ART) is a schematic illustration of an ink-jet hard copy apparatus in an elevation view.
Figure 3A:
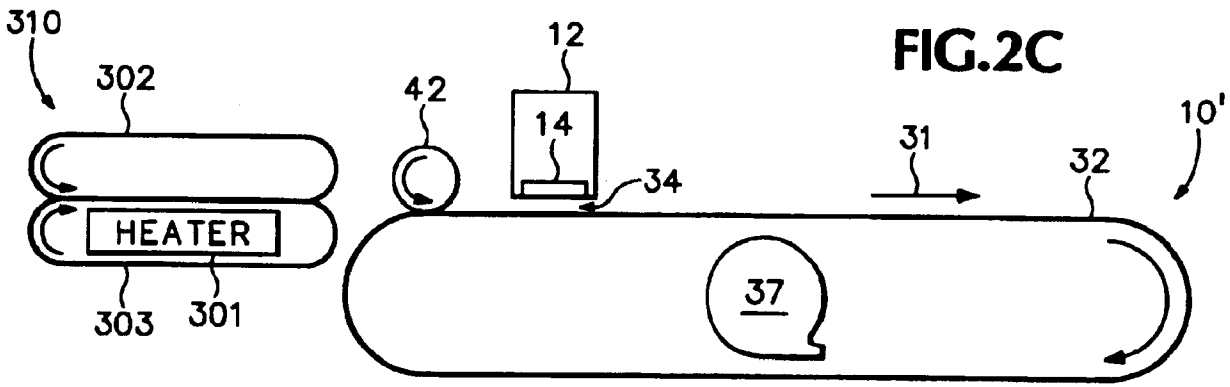
FIGS. 3A, 3B and 3C are schematic drawings of a second embodiment of the present invention, employing three paper transport belts.
Figure 3B:
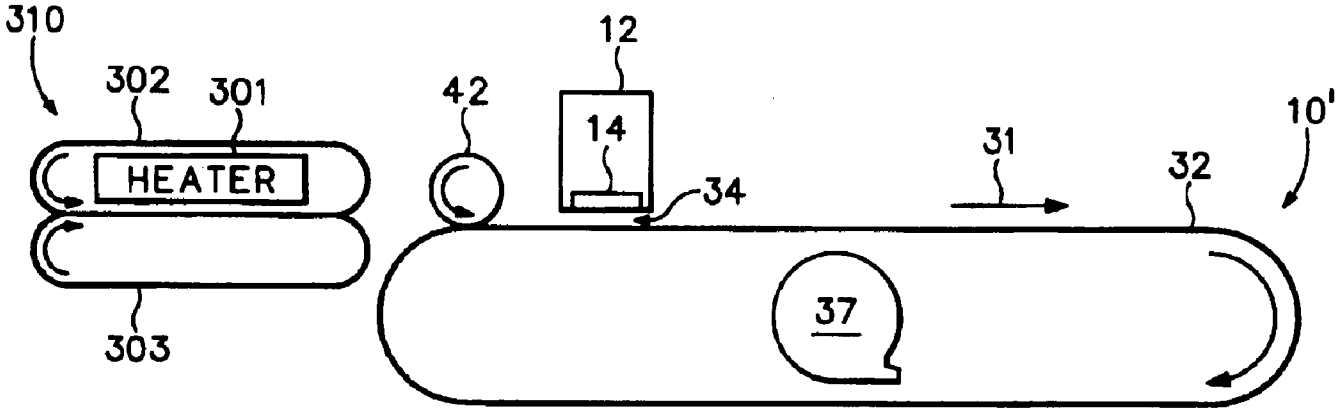
Figure 3C:
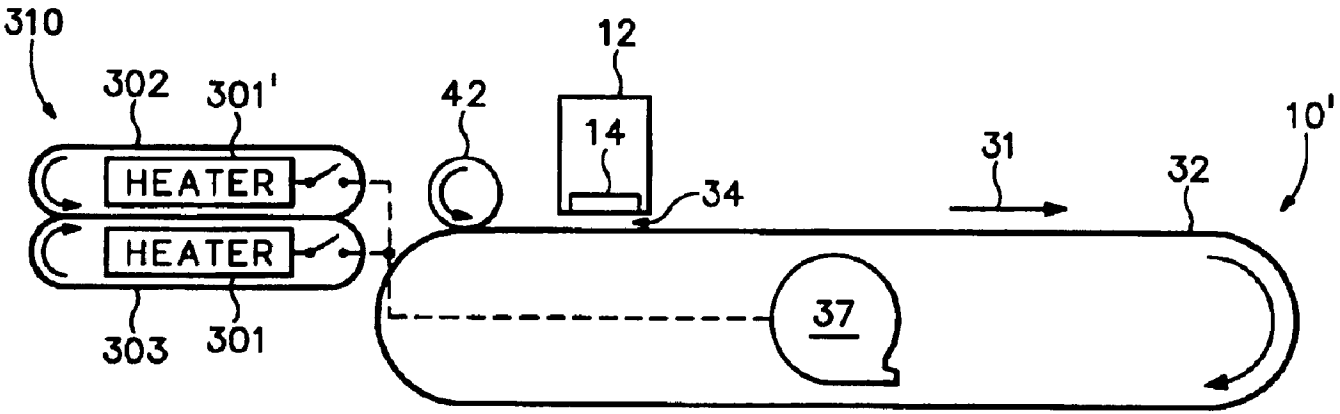

FIGS. 3A, 3B and 3C illustrate implementations of a three belt ink-jet printer system embodiment in accordance with the present invention. To the standard vacuum belt-type printer system—such as detailed in FIG. 1 and represented here schematically as print-zone subsystem 10'—a second, belt-type, print media preheat subsystem 310 is provided in the paper path 31 upstream of the print-zone subsystem. The preheat subsystem 310 has two belts 302, 303, at least one of which has a heater 301 device (see also heater element 301', FIG. 3C) associated with it as shown in various combinations by these three FIGURES. In a one heated belt implementation such as in FIGS. 3A and 3B, the unheated belt is used to provide contact force. Heating both belts such as in FIG. 3C provides the improved heat transfer advantages as described with respect to FIGS. 2A–2C.

FIG. 3C also demonstrates the option of providing vacuum to the preheat zone between the preheater subsystem 310 belts 302, 303 to assist with vapor removal and to improve heat transfer. Note that another embodiment such as depicted in FIGS. 3A and 3B but similarly employing vacuum with one of the belts 302, 303 is another option.

By separating the preheating subsystem 310 from the print-zone subsystem 10', relative motion between belts and media as described in the Background section is restricted to the preheating subsystem 310. In this construct, the separate subsystem 10', 310 belts can be run at different speeds based on throughput specifications to improve overall performance.

A pinch roller 42 (also in FIG. 1), positioned at the paper path 31 upstream entrance to the main vacuum belt 32 to square the media sheet, removing or at the least reducing, any skew before the leading edge enters the print-zone 34, can be used in conjunction with the present invention as described in further detail in assignee's U.S. patent application Ser. No. 09/542,504 by Wotton et al. on Apr. 3, 2000, for Linefeed Control in Belt-Type Printers (incorporated herein by reference).

The preheat subsystem 310 provides the advantage of running the preheater at intermittent speeds or continuous speed (versus ink-jet swath printing using stepped media advance). A buckling of the media between the preheat subsystem 310 and the downstream combination of the roller 42 and vacuum belt 32 can be allowed. In other words, a predetermined degree of buckling of the media is induced along the print media path between the upstream, heated transport mechanisms and the downstream point of contact with the vacuum belt. The preheating system 310 can be run at a different speed, including in continuous motion. This provides advantageous design options for implementing the present invention.

Again, the preheat subsystem 310 belts 302, 303 can be perforated to allow water vapor to escape. In a vacuum belt construct, as shown in each embodiment, again it is preferable that only one belt would be perforated so that the vacuum will pull against the other belt, providing vacuum-assisted pressing of the medium therebetween.

Figure 4:
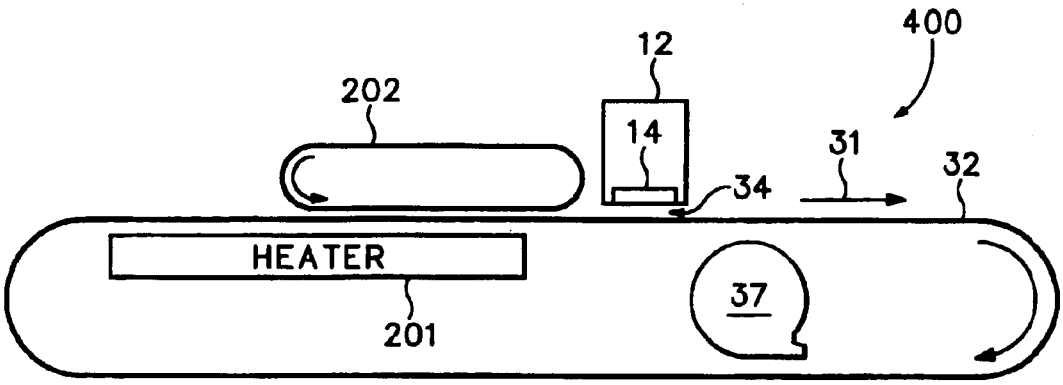
FIG. 4 is a preferred embodiment of a two belt embodiment the present invention.

FIG. 4 shows a seventh embodiment of an ink-jet printing system 400. It has been found that pre-heating a sheet of paper having a significant moisture contact before sandwiching, or "ironing," it between belts 32, 202 upstream of the print-zone will drive out a majority of the moisture prior to the sheet being captured by the nip formed between the belts. Most of the shrinkage will occur in this unconstrained sheet of paper "pre-shrink region" of the system 400. Width shrinkage (across the grain of the paper fibers) as much a 1.5% (three-millimeters in a 216-mm wide paper) has been observed; with the grain, shrinkage is approximately 50% the cross-grain amount. Use of a pre-shrink region reduces shrinkage during the actual ironing between the belts 32, 202 which otherwise could result in wrinkles, buckles, and folds in the paper sheet before it ever reaches the print-zone 34. It will be recognized by those skilled in the art that the time of contact between the sheet and heater 201 in the preshrink region of the system 400 will depend on the throughput of the implementation. A heated pre-shrink region of about 50 to 60 millimeters in the paper path 31 upstream of the nip between the belts 32, 202 should be adequate for most throughput speeds common to state of the art for print swaths of one-inch height or less.

Figure 5:
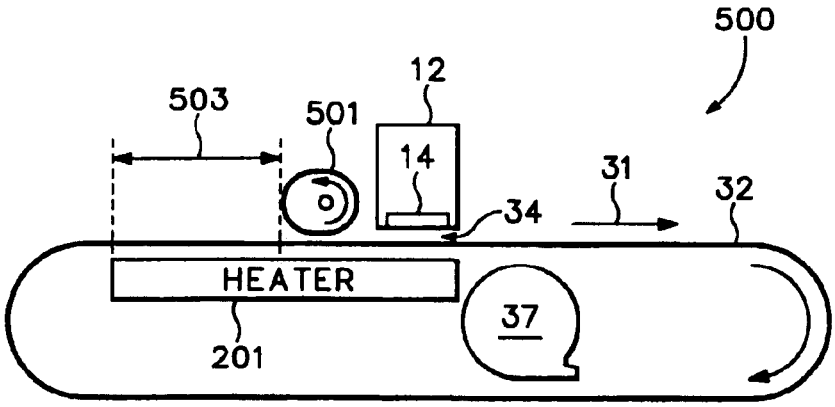
FIG. 5 is an alternative embodiment employing a soft material roller in conjunction with a main transport belt.

FIG. 5 shows another embodiment similar to the embodiment of FIG. 2A. However, the belt 202 has been replaced with a soft-material roller 501. The roller 501 is slightly greater in width than the largest paper width used in the system 500. The sheet of paper in the paper path 31 will cross a heated pre-shrink region 503 (as explained in conjunction with the embodiment of FIG. 4) upstream of a capture nip between the belt 32 and roller 501 outer surface. Passing the sheet thereafter at temperature, under pressure, for a period of time, through the contact area of the belt 32 and roller 501 will iron the sheet just prior to its entering the print-zone 34. Preferably, a relatively soft material such as cellular silicone foam should be employed for the roller 501, or at least its outermost layer to increase this contact area. A material with a durometer number (Shore A) in the range of twenty to sixty has been successfully employed. For common state-of-the-art ink-jet printers, a contact area of about 10 millimeters in the paper path direction has been found to provide adequate ironing of the sheet upstream of the print-zone 34. A pressure in the contact area in the range of about 6-to-15-inches-of water can be employed. It will be recognized by those skilled in the art that a specific implementation's specifications will be a function of temperature and pressure employed. Note that the concept of this embodiment can be extended to provide two rollers as the pressing mechanism.

In summary, the present invention provides a print media preheating method and apparatus that uses heat, vacuum, and mechanisms in combination for drying and flattening a sheet prior to ink-jet printing thereon. Pre-shrinking the media, driving out and substantially reducing inherent moisture content prior to depositing wet ink thereon provides greater flatness in the print-zone whereby ink-jet print quality is improved.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art; for example, while conductive heat type devices are illustrated, radiant heat devices or the like might be employed. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. An apparatus, comprising:

a vacuum belt for transporting media through a printing-zone;

a preheating subsystem including a pair of contact belts for feeding the media through the preheating subsystem and a heater associated with at least one of the contact belts, the preheating subsystem applying heat to the media before the media enters the printing-zone; and a roller associated with the vacuum belt proximate an output side of the preheating subsystem upstream or the printing-zone, the roller and the vacuum belt receiving a leading edge of the media in a roller-belt interface, buckling the media between the preheating subsystem and the roller-belt interface, and positioning the media in the printing-zone, wherein the contact belts run at a first speed and the roller-belt interface runs at a second speed associated with printing on the media, wherein the first and second speed form a degree of the buckling.

2. The apparatus as set forth in claim 1, wherein the roller and the vacuum belt receive the leading edge of the media in the roller-belt interface while upstream regions of the media are still within the preheating subsystem.

3. The apparatus as set forth in claim 1, wherein the heater provides a region for heating the media prior to the media entering a nip between the vacuum belt and the roller.

4. The apparatus as set forth in claim 3, wherein the heater drives moisture from the media prior to the media entering the nip.

5. A subsystem for a printing apparatus including a vacuum belt for transporting print media along a media path through a print zone, the subsystem comprising:

upstream of the print zone, means for transporting the print media alone the media path toward the print zone, the media transporting means including a pair of belts mounted in the media path upstream of the vacuum belt, wherein each face of the print media contacts a respective surface of one of the belts;

means for heating at least one surface of one of the belts such that heat is transferred to the print media therefrom;

upstream of the print zone and in contact with the vacuum belt, means for receiving a leading edge of the print media from the belts and retaining the print media, wherein the media retaining means and the vacuum belt contract is such that a predetermined degree of buckling of the print media is induced along the media path between the media transporting means and a point of contact of the media retaining means with the vacuum belt; and means for controlling the degree of buckling, including means for running said pair of belts at a first speed, up to and including a constant speed, means for running said media retaining means at a second speed associated with printing on the media, and means for associating said first speed and said second speed to form the degree of buckling.

6. The subsystem of claim 5, wherein at least one of the pair of belts of the media transporting means include a vacuum belt.

7. The subsystem of claim 5, wherein the heating means includes a heater mechanism associated with at least one of the pair of belts.

8. The subsystem of claim 5, wherein the heating means includes a pair of heater mechanisms each associated with a respective one of pair of belts.

9. The subsystem of claim 5, wherein the media retaining means includes a pinch roller in contact with the vacuum belt.

* * * * *

UNITED STATES PATENT AND TRADEMARK OFFICE

CERTIFICATE OF CORRECTION

PATENT NO. : 6,913,354 B2
APPLICATION NO. : 10/342505
DATED : July 5, 2005
INVENTOR(S) : Steve O. Rasmussen et al.

It is certified that error appears in the above-identified patent and that said Letters Patent is hereby corrected as shown below:

Column 8, Claim 5, line 41, delete “contract” and insert therefor --contact--

Signed and Sealed this

Twenty-third Day of January, 2007

JON W. DUDAS
*Director of the United States Patent and Trademark Office*